US007988267B2

(12) United States Patent
Shimizu

(10) Patent No.: US 7,988,267 B2
(45) Date of Patent: Aug. 2, 2011

(54) INK JET PRINTER

(75) Inventor: Yoichiro Shimizu, Kasugai (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 1035 days.

(21) Appl. No.: 11/827,261

(22) Filed: Jul. 11, 2007

(65) Prior Publication Data

US 2008/0018699 A1 Jan. 24, 2008

(30) Foreign Application Priority Data

Jul. 12, 2006 (JP) ..... 2006-191245

(51) Int. Cl.

| | |
|---|---|
| ***B41J 2/17*** | (2006.01) |
| ***B41J 2/165*** | (2006.01) |
| ***B41J 2/145*** | (2006.01) |
| ***B41J 2/175*** | (2006.01) |
| ***B41J 2/19*** | (2006.01) |

(52) U.S. Cl. ..... 347/84; 347/29; 347/30; 347/44; 347/85; 347/92

(58) Field of Classification Search ..... 347/29, 347/30, 44, 84, 85, 92, 93
See application file for complete search history.

(56) References Cited

U.S. PATENT DOCUMENTS

| | | | | |
|---|---|---|---|---|
| 2005/0122380 | A1 | 6/2005 | Nakamura et al. | |
| 2005/0195246 | A1* | 9/2005 | Ogawa | 347/65 |
| 2005/0253909 | A1* | 11/2005 | Usui | 347/92 |
| 2006/0001715 | A1 | 1/2006 | Umeda et al. | |

FOREIGN PATENT DOCUMENTS

| | | |
|---|---|---|
| JP | 2004-255861 | 9/2004 |
| JP | 2005-161761 | 6/2005 |

* cited by examiner

*Primary Examiner* — Charlie Peng
*Assistant Examiner* — Hung Lam
(74) *Attorney, Agent, or Firm* — Frommer Lawrence & Haug LLP

(57) ABSTRACT

A buffer tank mounted on a head holder has a plurality of air discharge valves for discharging the air accumulated in inks to the outside. The air discharge valve includes a valve body for opening and closing the passage bore and a valve rod provided extending from the valve body downwardly. A maintenance unit is provided outside the buffer tank, which includes an air discharge cap for covering the lower ends of the passage bores and a plurality of air discharge rods provided corresponding to the air discharge valves respectively. The air discharge rods are different in length from one another, depending on the colors of ink. When the air discharge rods are lifted up simultaneously by a lifting, they come into direct contact with the lower ends of the corresponding valve rods in sequence as their movements are delayed one after another, hence opening the valve bodies separately.

19 Claims, 8 Drawing Sheets

INK JET PRINTER

CROSS-REFERENCE TO RELATED APPLICATIONS

The present application claims priority under 35 U.S.C. §119(a) on Patent Application No. 2006-191245 filed in Japan on Jul. 12, 2006, the entire contents of which are hereby incorporated by reference.

TECHNICAL FIELD

The present invention relates to an ink jet printer.

BACKGROUND

An ink jet printer is known, such as disclosed in Japanese Patent Application Laid-Open No. 2004-255861, where a recording head equipped including a plurality of nozzles for discharging a plurality of inks is fixedly mounted to the bottom of a substantially box-like shaped head holder functioning as a carriage with the nozzles being exposed at the bottom of the head holder, while a buffer tank including a plurality of ink storage chambers is provided above the recording head. The inks are fed from their respective ink cartridges or ink supply sources via tubes to the buffer tank from which they are delivered to the corresponding nozzles in the recording head before they are ejected from the nozzles for printing on a sheet of recording paper.

In such an ink jet printer, when bubbles of air are produced in the ink, they may block the flow passage in the recording head and thus interrupt discharge of the ink from the nozzle. It is hence essential to remove the bubbles of air from the ink. For the purpose, the bubbles of air are accumulated in the buffer tank by lifting up the bubbles of air in the ink received from the ink cartridge. A plurality of air discharge units are provided in one side of the buffer tank for discharging the air to the outside. FIG. 1 is a side cross sectional view of a conventional buffer tank 100 accompanied with the air discharge units 101. The air discharge unit 101 is provided for each ink including an opening at the lower end 101*a*, an air discharge passage 102, an air discharge valve 103, and a spring member 104 for producing an elastic force to press and hold the air discharge valve 103 in the closing state. As air has been accumulated in the buffer tank 100, it is discharged from the air discharge passage 102 to the outside by properly controlling the air discharge value 103. The air discharge valve 103 is composed mainly of a valve body 103*a* acting as a valve for opening and closing the air discharge passage 102 with the help of the elastic force of the spring member 104 and a valve rod 103*b* extending from the valve body 103*a* to the lower. The valve body 103*a* remains pressed by the spring member 104 against the inner wall A of the air discharge passage 102 in the normal state (during printing).

Before discharging the air from the air discharge unit 101, the carriage is moved to the location of an open/close unit 110 provided outside the scanning movement of the carriage for conducting printing. The open/close unit 110 includes air discharge caps 106 for closing the lower openings 101*a* of the air discharge units 101 and air discharge rods 107 corresponding to the valve rods 103*b* so as to be operable selectively by a lifting unit for upward and downward movement. Before discharging the air, the air discharge cap 106 is moved to close the lower openings 101*a* of the air discharge units 101 for permitting to start sucking by the lifting unit. Substantially at the same time, the air discharge rods 107 are lifted up to come into direct contact with and elevate their respective valve rods 103*b* for producing the valve opening state where the valve bodies 103*a* depart from the inner wall A.

SUMMARY

In the buffer tank 100 described above, the force required for lifting up the valve rod 103*b* of each air discharge unit 101 and its corresponding air discharge rod 107 is equal to a sum of the force of resisting against the elastic force of the spring member 104 and the force of resisting the adhesive power of a packing provided between the valve body 103*a* and the inner wall A. Also, as the air discharge valves 103 are opened simultaneously, the open/close unit 110 receives a load of multiplying the sum by the number of the units 101 and its action may be declined in the stableness. For overcoming the load, the lifting unit for the open/close unit 110 has to be increased in the size or modified by replacing its components with more rigid components and its cost up will hardly be avoided.

In an attempt to solve the problems above, it is an object to open and close the air discharge valves at higher stability with the use of a simpler arrangement through minimizing the load exerted on the open/close unit during the opening and closing of the air discharge valves in the buffer tank.

For achievement of the object, an ink jet printer according to a first aspect is characterized by an ink jet printer comprising: a recording head for discharging a plurality of inks from a plurality of nozzles to print on a recording medium; a tank having a plurality of storage chambers for respectively storing the plurality of inks to be supplied to the recording head; a plurality of air discharge passages for discharging air in the plurality of storage chambers respectively to outside; a plurality of air discharge valves provided respectively in the air discharge passages so as to be opened and closed; and an open/close unit provided outside the tank for opening and closing the air discharge valves, wherein the first air discharge valve of the plurality of air discharge valves and the open/close unit are located in such a positional relationship that the first air discharge valve is opened and closed as delayed with respect to the second air discharge valve of the plurality of air discharge valves.

According to the first aspect, the first air discharge valve of the plurality of air discharge valves and the open/close unit are located in such a positional relationship that the first air discharge valve is opened and closed as delayed with respect to the second air discharge valve of the plurality of air discharge valves. This allows the load received by the open/close unit to be separated during opening and closing of the air discharge valves which can thus be performed at stability. Also, the mechanism for driving the open/close unit as well as the arrangement of the open/close unit can remain not large in the size and not high in the overall cost, contributing to the improvement of the productivity.

The above and further objects and features will more fully be apparent from the following detailed description with accompanying drawings.

DETAILED DESCRIPTION

Embodiments will be described in more detail referring to the relevant drawings. It is assumed for the description that the side where ink is discharged towards a recording medium is defined at the lower side or in the downward direction and its opposite side is defined at the upper side or in the upward direction. The action of scanning of a head holder 7 (denoted by X) shown in FIG. 2 is conducted along leftward and rightward directions.

Figure 1:
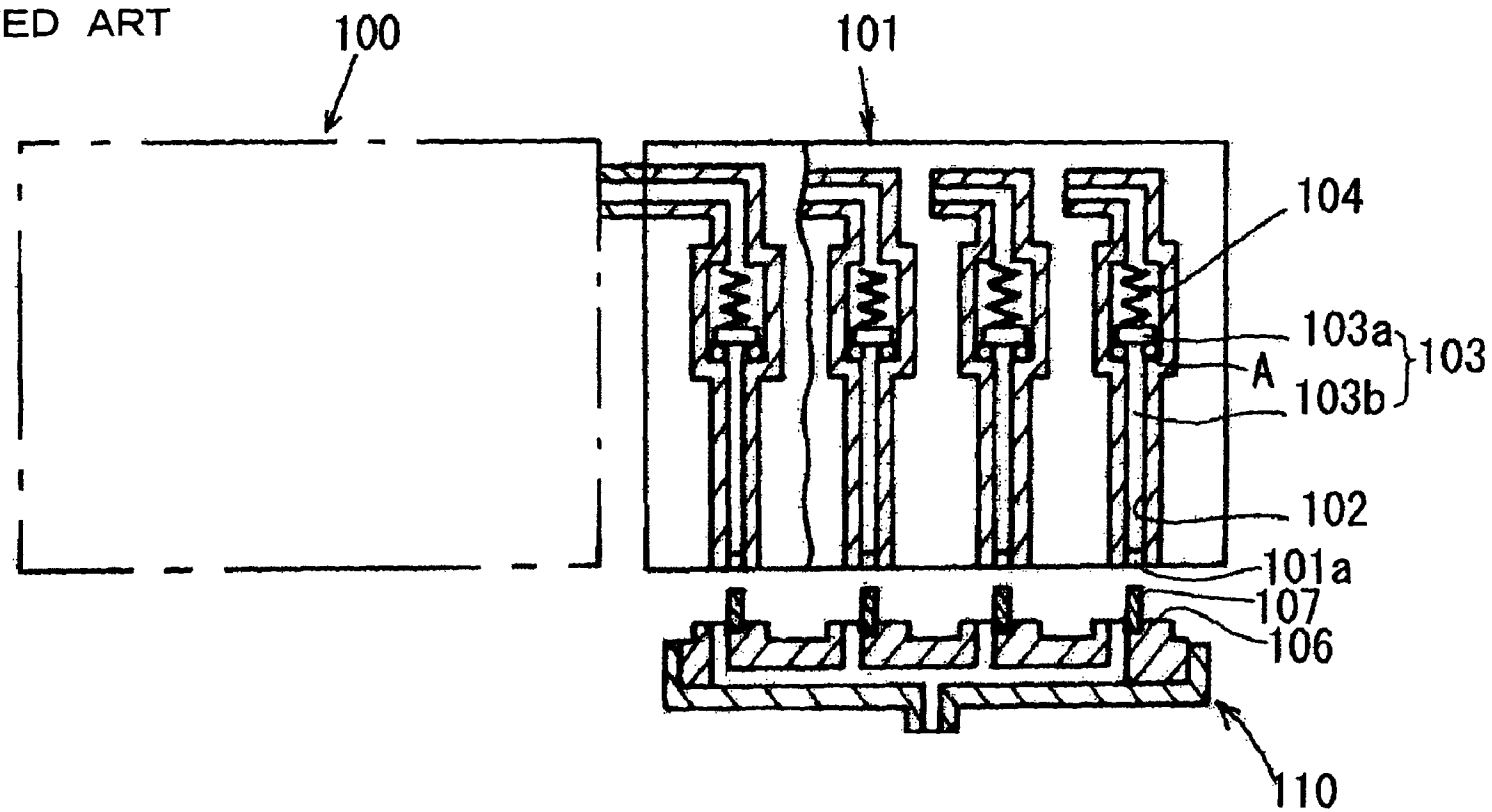
FIG. 1 RELATED ART
FIG. 1 is a cross sectional view of an air discharge unit of the related art.
Figure 2:
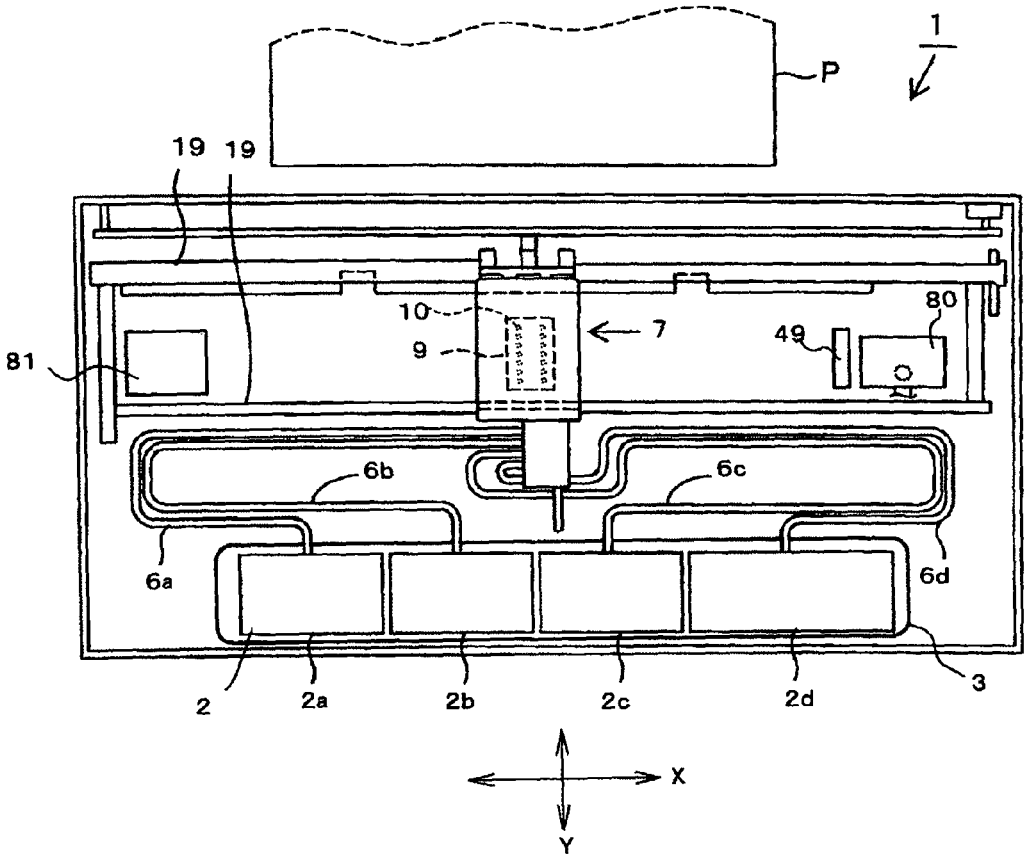
FIG. 2 is a plan view of an ink jet printer.

Referring to FIG. 2, an ink jet printer 1 will be described briefly. The ink jet printer 1 is arranged in which a flow of ink is fed from an ink cartridge 2 mounted replaceably in a mounting section 3 for storing the ink to a recording head 9 mounted to a head holder 7 of substantially a box-like shape functioning as a carriage. The head holder 7 is slidably mounted on a pair of guide shafts 19, 19 extending in parallel to each other. As the head holder 7 travels in the scanning direction (denoted by X to the left and right), the recording head 9 discharges ink from its nozzles 10 to produce a print on a recording medium P which runs in a direction (denoted by Y) extending at a right angle to the scanning direction.

The ink cartridges 2 (separately denoted by 2*a*, 2*b*, 2*c*, and 2*d*) are provided for storing, for example, black ink B, cyan ink C, yellow ink Y, and magenta ink M respectively. The ink cartridges 2 are communicated with ink feeding tubes 6 (separately denoted by 6*a*, 6*b*, 6*c*, and 6*d*) for feeding the colors of ink to the recording head 9.

A maintenance unit 80 is provided at one end along the leftward and rightward directions (denoted by X) of the ink jet printer 1 and beneath the guide shafts 19, 19 for sucking the ink from the nozzles 10 thus to prevent any fault in discharge of the ink. Also, a known wiper member 49 is provided beside the maintenance unit 80 for cleaning the nozzle face of the recording head 9. Provided at the other end of the printer 1 is a flashing receiver 81 for periodically or forcefully discharging the ink from the nozzles 10 in the recording head 9 thus to prevent any fault during discharge of the ink. The maintenance unit 80 will be described later in more detail.

Figure 3:
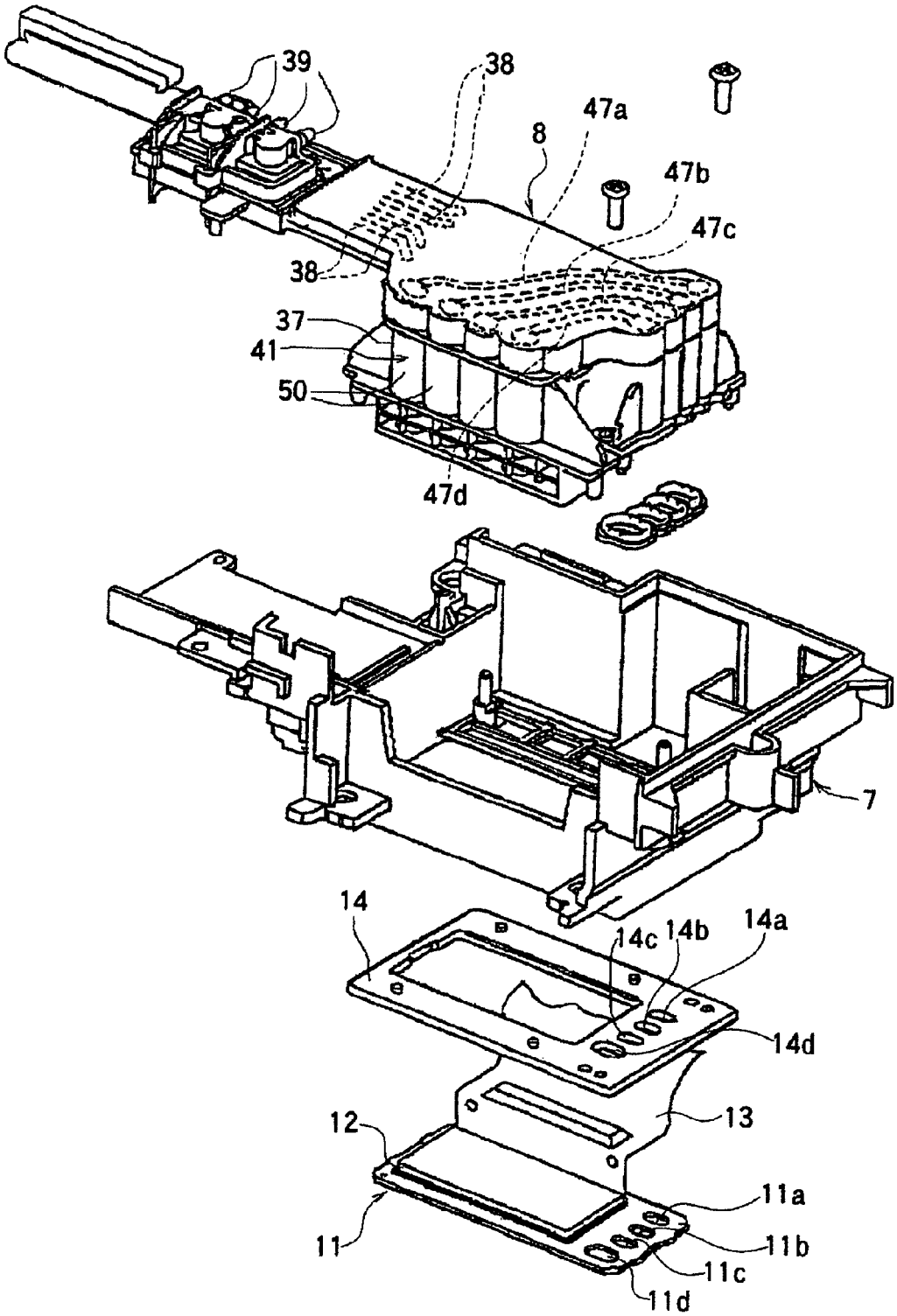
FIG. 3 is an exploded perspective view of a head holder.
Figure 6:
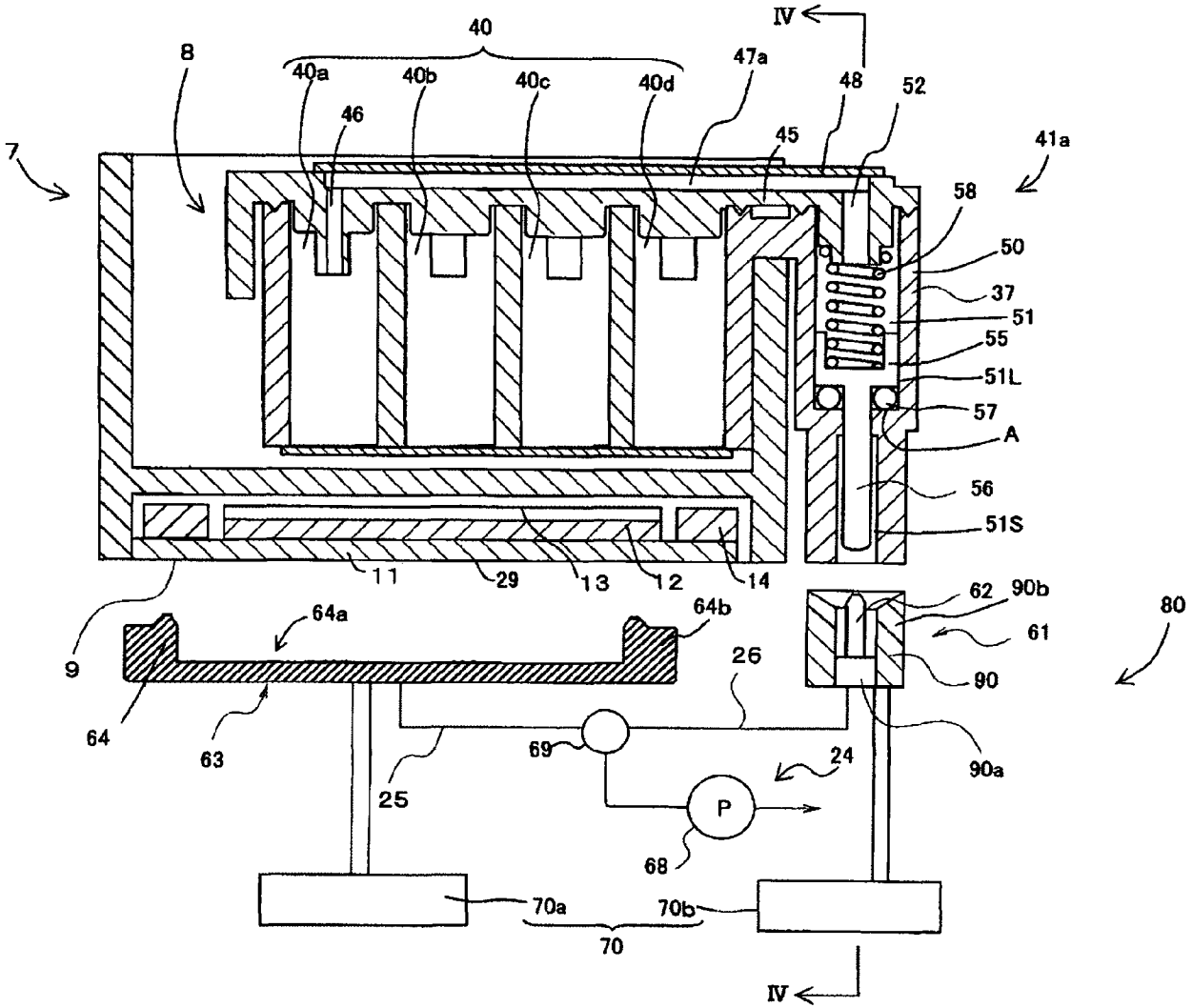
FIG. 6 is a transversely cross sectional view of the head holder with a recovery unit and an open/close unit taken along the line II-II of FIG. 4 in the X direction.

The recording head 9 having rows of the nozzles 10 for the respective color inks is fixedly mounted to the bottom of the head holder 7 via a mounting plate 14 as shown in FIGS. 3 and 6. A buffer tank 8 including a plurality of storage chambers 40 (separately denoted by 40*a*, 40*b*, 40*c*, and 40*d*) for the respective color inks and a case 37 containing air discharge units 41 located next to a side wall of the buffer tank 8 are provided above the recording head 9. The head holder 7 has an opening provided in the bottom thereof so that the nozzle face 29 where the nozzles 10 are provided, located at the lowermost of the recording head 9 is exposed at the opening. The recording head 9 is generally composed of an assembly of plates bonded to one another in layers as disclosed in, for example, Japanese Patent Application Laid-Open No. 2005-161761 where a flexible wiring material 13 in which a driving circuit is provided is joined to the upper side of a combination of a cavity unit 11 to be fed with the color inks from the buffer tank 8 and a piezoelectric actuator 12 of plate type having piezoelectric deformable parts, which all are electrically connected to one another. Although not shown, the rows of the nozzles 10 for discharging their respective color inks are aligned along the scanning direction (denoted by X) of the head holder 7 on the nozzle face 29 at the lowermost of the cavity unit 11. When the piezoelectric deformable parts are selectively deformed by a printing signal received from the driving circuit, the corresponding nozzles 10 discharge the color inks. The cavity unit 11 has ink feeding apertures 11*a* to 11*d* provided therein for feeding the color inks from the buffer tank across the cavity unit 11 to their respective nozzles 10.

The buffer tank 8 will now be described in more detail referring to FIGS. 3 to 7A and 7B.

Figure 4:
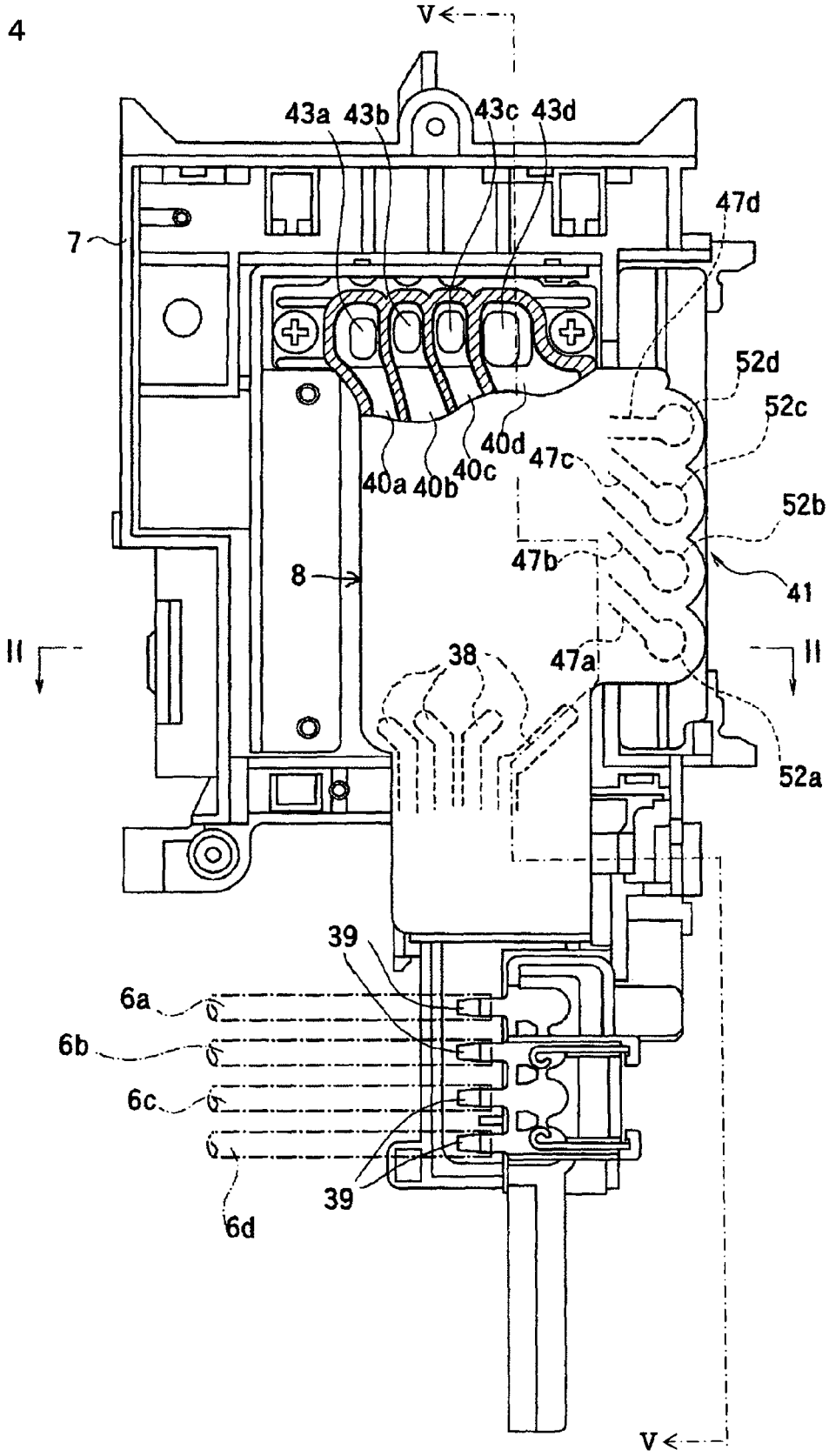
FIG. 4 is a plan view of the head holder.

As shown in FIGS. 3 and 4, the buffer tank 8 is made of a synthetic resin material including the storage chambers 40 (40*a* to 40*d*), and on one side of the buffer tank 8 joints 39 are arranged laterally for communication with their respective ink feeding tubes 6*a* to 6*d* to feed the color inks respectively. This allows the color inks received from the ink cartridges 2 to flow from the joints 39 via corresponding feeding passages 38 to their respective storage chambers 40*a* to 40*d* for storage. The color inks are subjected to the action of lifting up and separating the bubbles of air in the storage chambers 40 and then conveyed from the outlets 43*a* to 43*d* downwardly provided in the bottom of the buffer tank 8 across the communication apertures 14*a* to 14*d* provided in the mounting plate 14 to the ink feeding apertures 11*a* to 11*d* provided in the recording head 9.

Figure 5:
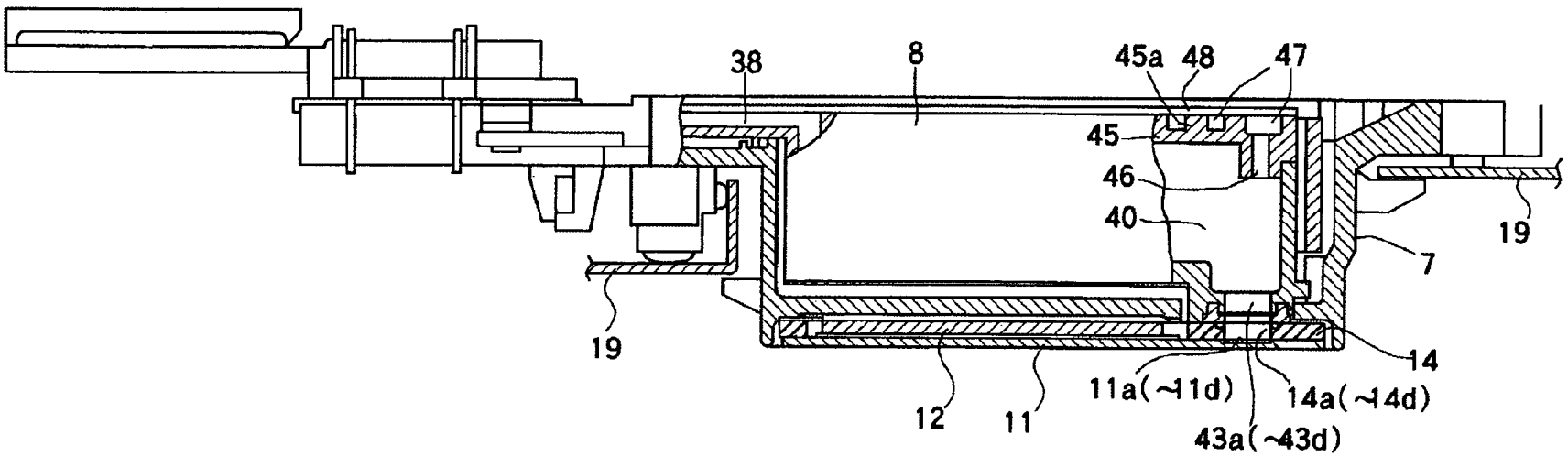
FIG. 5 is a longitudinally cross sectional view of the head holder taken along the line V-V of FIG. 4 which extends at a right angle to the X direction.

As shown in FIGS. 5 and 6, a suction opening 46 of a tubular shape is downwardly provided in a ceiling wall 45 of each of the storage chambers 40 for sucking the ink with air and communicated at the upper end with a suction passage 47 (separately denoted by 47*a* to 47*d*) which is provided at the upper side in the ceiling wall 45 to act as an air bubbles discharge passage which communicates with the inlet of the case 37. More specifically, the suction passage 47 is communicated at the other end to a corresponding passage tube 52, which will be explained later, in the air discharge unit 41 for discharging the bubbles of air to the outside. In addition, air accumulated in the storage chamber 40 is escapes from the upper side or namely the ceiling wall 45 of the buffer tank 8 while not flowing into the recording head 9 located beneath, whereby the recording head 9 will be protected from being choked with the air at the ink passage.

Each of the suction passages 47*a* to 47*d* is defined between a recess provided in the upper side of the ceiling wall 45 and a film body 48 made of, for example, synthetic resin film for covering the recess. Denoted by 45*a* in FIG. 5 is a partition which separates the suction passages 47*a* to 47*d* from one another and is bonded at the upper side with the film body 48.

With the suction opening 46 in the tubular part of the storage chamber 40 properly sized to a depth extending downwardly from the lower side of the ceiling wall 45, an air pool at a desired volume remaining not escaping from the suction opening 46 is formed at the upper part of the storage chamber 40 and can thus absorb any change in the pressure of the ink stored in the storage chamber 40 which results from the leftward and rightward movement of the head holder 7.

The air discharge unit 41 will then be described.

The air discharge units 41 are located next to one side (the right side in FIG. 6) of the buffer tank 8 in the case 37 made of synthetic resin. More specifically, four of the air discharge units 41 (separately denoted by 41*a* to 41*d*) are provided in parallel communicating with their respective suction passages 47*a* to 47*d* (See FIGS. 7A and 7B). Each of the four air discharge units 41*a* to 41*d* is arranged in the form of a cylinder block 50 which has a passage bore 51 provided therein to extend vertically. As shown in FIG. 6, a passage tube 52 communicated to the end of the suction passage 47 is provided to extend downwardly from the ceiling wall 45 and communicated to the upper end of the passage bore 51. In brief, the suction opening 46, the suction passage 47, the passage tube 52, and the passage bore 51 are all communicated to form an air discharge passage. While the air discharge unit 41*a* communicating from the suction passage 47*a* in the storage chamber 40*a* is illustrated in FIG. 6, the other air discharge units 41*b* to 41*d* communicating from their respective suction passage 47*b* to 47*d* in the storage chambers 40*b* to 40*d* are identical in the arrangement.

Each of the passage bores 51 includes a large diameter part 51L at the upper half and a small diameter passage 51S at the lower half. There is a step A provided between the two parts which acts as a valve seat. The air discharge valve includes a large diameter valve body 55 for opening and closing the above-described air discharge passage and a small diameter valve rod 56 provided integrally with the lower end of the valve body 55. Also, an elastic member or packing 57 is provided, such as an O ring for sealing, on the lower side of the valve body 55 as fitted onto the valve rod 56. The valve body 55 accompanied with the packing 57 is accommodated in the large diameter part 51L with a gap provided therebetween for passing the air so that it can travel upwardly and downwardly. The valve rod 56 is inserted into the small diameter passage 51S with a gap provided therebetween for passing the air and the lower end of the valve rod 56 extends close to an opening at the lower end of the small diameter passage 51S. The valve body 55 remain urged downwardly by the elastic force of a spring 58, such as a coil spring, provide in the large diameter part 51L. This allows the packing 57 to be pressed against the step A or the lowermost end of the large diameter part 51L of the passage bore 51, whereby the valve remains closed. When an air discharge rod 62, which will be described later, is lifted up and upwardly presses the valve rod 56 as resisting the elastic force of the spring 58, the packing 57 departs from the step A thus opening the valve. Accordingly, as the air discharger passage is communicated to the outside, it allows the bubbles of air to be discharged outwardly.

The maintenance unit 80 will be described referring to FIG. 6. The maintenance unit 80 includes a recovery unit 63 for, while the head holder 7 is held at its standby state (at the right end in FIG. 2 in the embodiment), sucking remaining ink of which the viscosity has been increased, small dirt, and trapped air from the nozzles 10 of the recording head 9 in the head holder 7 and an open/close unit 61 for drawing the bubbles of air accumulated in the storage chambers 40 from the suction passages 47 and the air discharge units 41 as well as the drops of ink which have come out with the bubble of air. The recover unit 63 is located adjacent to the open/close unit 61. The open/close unit 61 is located at the outermost end along the moving direction (denoted by X) of the head holder 7. Although not shown in FIG. 6, in a plan view, the wiper member 49 for cleaning down the nozzle face 29 of the recording head 9 is located on the opposite side of a discharge cap 90 of the open/close unit 61 in which the air discharge rods 62 are provided, with a nozzle cap 64 of the recovery unit 63 being interposed therebetween.

The maintenance unit 80 further includes lifting units (actuators) 70 (separately denoted by 70*a* and 70*b*) for lifting up and down the recovery unit 63 and the open/close unit 61 respectively. As the lifting units 70*a* and 70*b*, known mechanisms for lifting up and down as the head holder 7 is moved to the standby position or motor powered driving mechanism may be applied. Furthermore, the maintenance unit 80 includes a suction pump 68 (suction unit) for sucking the ink and a switching valve unit 69 for selectively connecting the force of suction of the suction pump 68 to the recovery unit 63 and the open/close unit 61.

The nozzle cap 64 in the recovery unit 63 is arranged of substantially a rectangular shape for coming into direct contact with the nozzle face 29 of the recording head 9 to entirely cover the nozzles 10 exposed from the lower side of the head holder 7. The nozzle cap 64 includes a bottom portion 64*a* and a rim portion 64*b* provided extending upwardly from the circumferential edge of the bottom portion 64*a* and may have partitions provided thereon for inhibiting the different color inks from being mixed up when having been discharged. The nozzle cap 64 has an ink suction hole (not shown) provided in the bottom portion 64*a* thereof for communicating by the tube 25 via the switching valve unit 69 to the suction pump 68. This allows the inks to be drawn out from the nozzles 10 when the nozzle cap 64 has been lifted up by the lifting unit 70*a* so that its rim portions 64*b* has come into direct contact with the nozzle face 29 to entire cover the nozzles 10 and then communicated with the suction pump 68 by the switching valve unit 69. Also, when no suction of the ink with the nozzle cap 64 is desired, the switching valve unit 69 stays at the position for canceling the communication between the nozzle cap 64 and the suction pump 68, thus permitting no evaporation and ensuring the meniscus of the ink.

As shown in FIG. 6, the air discharge cap 90 in the open/close unit 61 is made of an elastic material for closely coming into contact with the circumference of lower ends of the passage bores 51 of the cylinder block 50. The air discharge cap 90 includes a bottom portion 90*a* and a rim portion 90*b* provided extending upwardly from the circumferential edge of the bottom portion 90*a*. The bottom portion 90*a* has air discharge rods 62 provided upwardly thereon to come into direct contact with the corresponding valve rods 56 and air discharge outlets, not shown, provided therein to communicate with the corresponding air discharge tubes 26. The air discharge tubes 26 are communicated via the switching valve unit 69 to the suction pump 68 for allowing the unwanted inks released from the suction pump 68 to be saved in a known waste ink container (not shown). The switching valve unit 69 is switched between three positions for connecting the nozzle cap 64 to the suction pump 68, for connecting the air discharge cap 90 to the suction pump 68, and for connecting none. The open/close unit 61 is arranged to be driven upon synchronization with the upward movement of the nozzle cap 64 by the lifting unit 70*a* for lifting up until its rim portion 90*b* comes into direct contact with the circumference of the lower ends of the passage bores 51 of the cylinder block 50 and it is ready for starting the sucking action. The air discharge rods 62 is arranged to be driven by the lifting unit 70*b* for selectively lifting up and down along the vertical. When the air discharge rods 62 lifts up and presses the corresponding valve rods 56 upwardly as resisting against the elastic forces of the springs 58, the packings 57 depart from their respective valve seats A thus to establish the valve opening state and communicate with the outside or atmosphere.

Figure 7A:
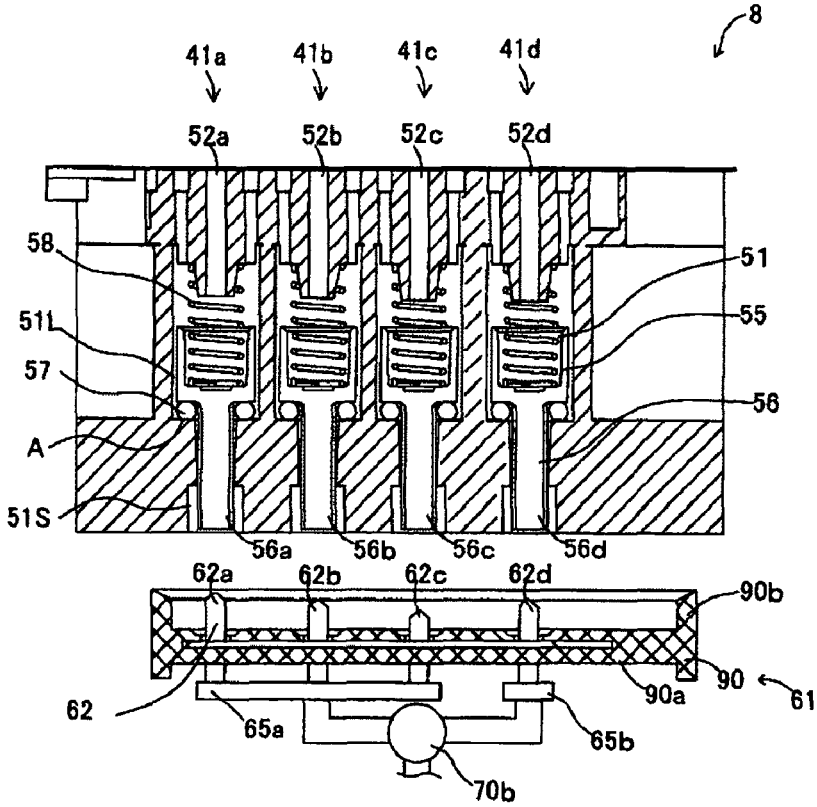
FIGS. 7A and 7B are cross sectional views taken along the line IV-IV of FIG. 6 showing different steps of the action.
Figure 7B:
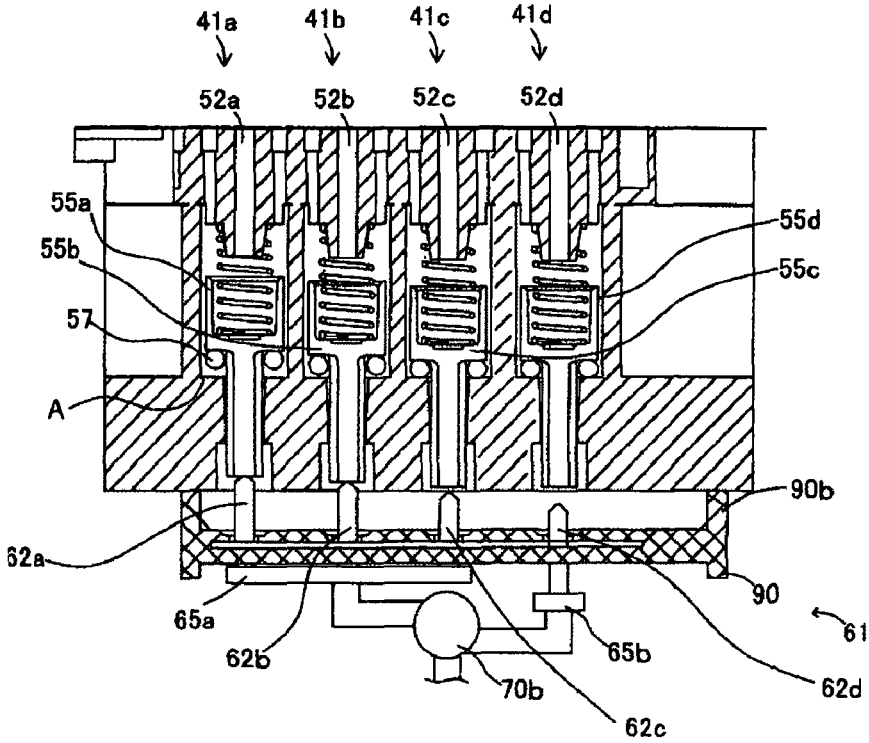

The air discharge units 41 and the open/close unit 61 in the buffer tank 8 of this embodiment will be described in more detail referring to FIGS. 7A and 7B. FIGS. 7A and 7B are side cross sectional views showing the actions of the open/close unit 61 for discharging the air in the inks from the air discharge units 41 in the buffer tank 8.

In the embodiment shown in FIGS. 7A and 7B, the air discharge valve composed of the valve body 55 and the valve rod 56 is installed in each of the passages bores 51 communicated with their respective storage chambers 40*a* to 40*d* while the lower ends of the valve rods 56 remain held at the same level. As the air discharge rods 62 (separately denoted by 62*a*, 62*b*, 62*c*, and 62*d*) of the open/close unit 61 extend to face the corresponding valve rods 56, three air discharge rods 62*a*, 62*b*, and 62*c* of them is supported by a supporting board 65*a* while the other air discharge rod 62*d* is supported by a supporting board 65*b*. This allows the three air discharge rods 62*a*, 62*b*, and 62*c* to be lifted up at the same time by the lifting unit 70*b* while the other air discharge rod 62*d* is lifted up with a delay in time. Further, the air discharge rods 62*a*, 62*b*, and 62*c* to be lifted up and down simultaneously are different from one another in length, as expressed by 62*a*>62*b*>62*c*.

As shown in FIG. 7B, for discharging the air from the buffer tank 8, the air discharge cap 90 is lifted up by the lifting unit 70*b* to cover the opening at the lower end of the respective small diameter passage 51S, thereby ready for suction. When the three air discharge rods 62*a*, 62*b*, ad 62*c* are lifted up simultaneously by the further action of the lifting unit 70*b*, they come into direct contact with their respective valve rods 56*a*, 56*b*, and 56*c* in sequence depending on the length. As resisting against the elastic force of the springs 58 and the adhesive power of the packings 57 to the steps A, the three air discharge rods 62*a*, 62*b*, ad 62*c* press and lift up the lower ends of their respective valve rods 56*a*, 56*b*, and 56*c* in sequence with a delay in time thus to open the valve bodies 55*a*, 55*b*, and 55*c* separately in this order. This is then followed by opening the valve body 55*d*. Since the three air discharge rods 62*a*, 62*b*, and 62*c* are different from one another in length in order, the air discharge valves are opened in sequence with a delay even if the plurality of air discharge rods 62*a*, 62*b*, and 62*c* are lifted up and down at the same time. Accordingly, the load received by the lifting unit 70 can be dispersed.

Figure 8A:
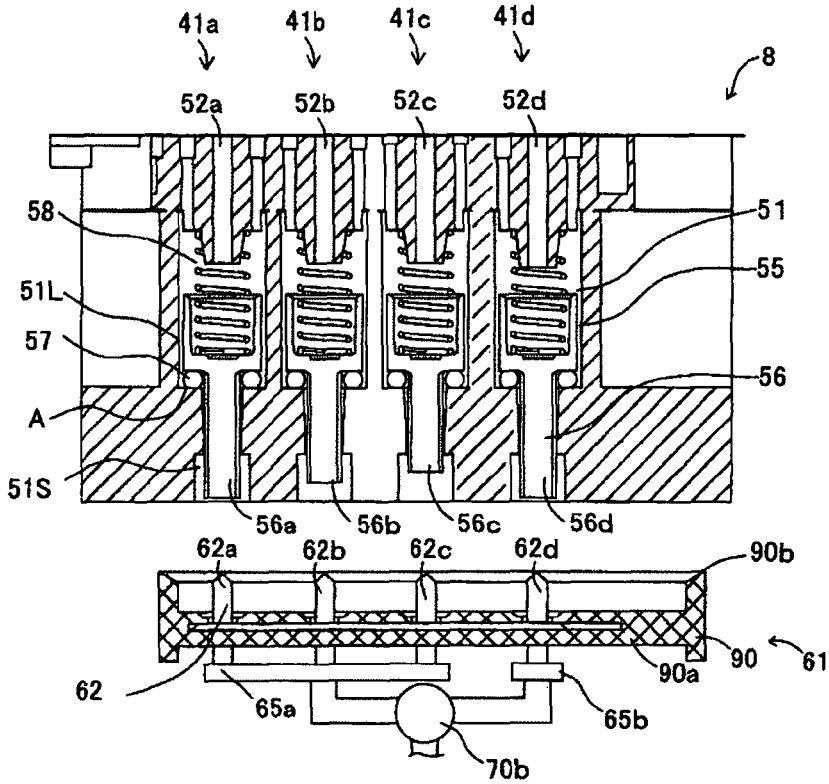
FIGS. 8A and 8B are cross sectional views, similar to FIGS. 7A and 7B, showing another embodiment.
Figure 8B:
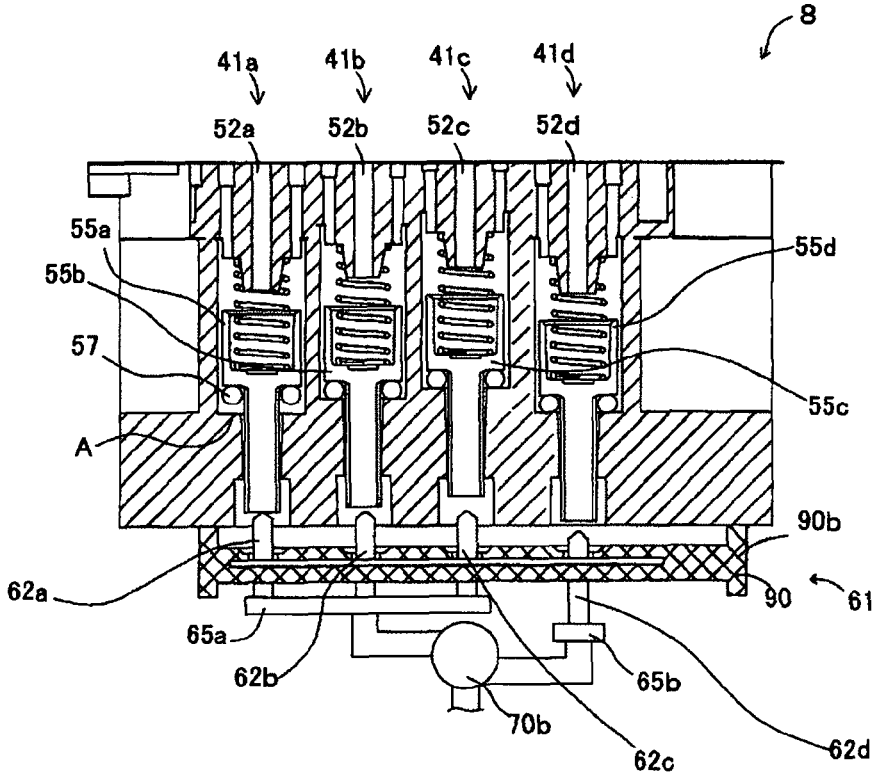

FIGS. 8A and 8B illustrate other embodiments. The embodiment shown in FIG. 8A permits the three air discharge rods 62*a*, 62*b*, and 62*c* to be equal in the length but the three valve rods 56*a*, 56*b*, and 56*c* in their respective air discharge units 41*a*, 41*b*, and 41*c* to be different from one another in length as expressed by 56*a*>56*b*>56*c*. As the steps A in the three air discharge units 41*a*, 41*b*, and 41*c* are equal in the level, the valve rods 56*a*, 56*b*, and 56*c* are separated at the lower end with different distances from the upper ends of the air discharge rods 62*a*, 62*b*, and 62*c* with the air discharge units 41*a*, 41*b*, and 41*c* remaining disengaged with the open/close unit 61. Similar to those shown in FIGS. 7A and 7B, the three air discharge rods 62*a*, 62*b*, and 62*c* and the other air discharge rod 62*d* are supported by a supporting board 65*a* and a supporting board 65*b* respectively, allowing the three air discharge rods 62*a*, 62*b*, and 62*c* to be lifted up and down simultaneously. Accordingly, when the open/close unit 61 is activated to move towards the air discharge units 41, its air discharge rods 62*a*, 62*b*, and 62*c* reach and lift up the corresponding valve rods 56*a*, 56*b*, and 56*c* in sequence with a delay in time. As the result, the three corresponding valve bodies 55*a*, 55*b*, and 55*c* can be opened one after another by the sequential action of the three valve rods 56*a*, 56*b*, and 56*c*.

The embodiment shown in FIG. 8B permits the three air discharge rods 62*a*, 62*b*, and 62*c* to be equal in the length but the steps A of the three air discharge units 41*a*, 41*b*, and 41*c* to be arranged different from one another in level as expressed by 41*a*<41*b*<41*c*. Meanwhile, the air discharge valves in the three air discharge units 41*a*, 41*b*, and 41*c* are identical in the dimensional arrangement. The three passages tube 52*a*, 52*b*, and 52*c* at the upper ends of the springs 58 are different from one another in length as expressed by 52*a*>52*b*>52*c* for making their elastic forces equal to one another. This allows the valve rods 56*a*, 56*b*, and 56*c* are separated at the lower end with different distances from the upper ends of the air discharge rods 62*a*, 62*b*, and 62*c* when the air discharge units 41*a*, 41*b*, and 41*c* remains disengaged with the open/close unit 61.

Similar to those shown in FIGS. 7A and 7B, the three air discharge rods 62*a*, 62*b*, and 62*c* and the other air discharge rod 62*d* are supported by a supporting board 65*a* and a supporting board 65*b* respectively, allowing the three air discharge rods 62*a*, 62*b*, and 62*c* to be lifted up simultaneously. Accordingly, when the open/close unit 61 is activated to move towards the air discharge units 41, its upward movement causes the air discharge valves to be opened in sequence from the lowest to the highest of the step A with a delay in time. As the result, the load received by the lifting unit 70*b* can be separated.

In such an embodiment, the storage chambers 40*a*, 40*b*, and 40*c* communicated to the corresponding valve bodies 55*a*, 55*b*, and 55*c* may contain the color inks of cyan, magenta, and yellow respectively while the storage chamber 40*d* communicated to the valve body 55*d* contains the pigmented ink of black. When the three valves 55*a*, 55*b*, and 55*c* for the color inks have been opened in sequence, their corresponding storage chamber 40*a*, 40*b*, and 40*c* are exhausted of air by the action of the suction pump 68. This is followed by driving the lifting unit 70*b* again to open the valve body 55*d* for the black ink and then driving the suction pump 68 to remove the air from the storage chamber 40*d*. Those air discharging actions may be conducted in any order when desired.

Although the lifting unit 70*b* is activated separately for the three colors and the one black color in the above embodiment, all the air discharge rods 62 for all the color inks may be provided on a single supporting board and lifted up and down simultaneously so as to open all the valve bodies 55 in sequence with a delay in time according to the above structure. Alternatively, the valve bodies 55 may be opened not one by one in sequence but two simultaneously and then the remaining one or two with a delay.

While the three storage chambers 40*a*, 40*b*, and 40*c* where the color inks are stored and the storage chamber 40*d* where the black ink is stored are exhausted of air sequentially in two steps in the embodiment, the two steps may be conducted independently by separate controlling actions.

Since the action of discharging the air from the buffer tank is carried out by the sequential opening actions of the air discharge valves with the air discharge rods 62*a* to 62*d* lifted simultaneously, the load received by the lifting unit 70 can be separated thus allowing the lifting action to remain stable. Also, the components in the embodiments can be improved without increasing the overall cost or the overall dimensions while the overall arrangement stays simple.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. An ink jet printer comprising:

a recording head for discharging a plurality of inks from a plurality of nozzles to print on a recording medium;

a tank having a plurality of storage chambers for respectively storing the plurality of inks to be supplied to the recording head;

a plurality of air discharge passages for discharging air in the plurality of storage chambers respectively to outside;

a plurality of air discharge valves provided respectively in the air discharge passages so as to be opened and closed; and an open/close unit provided outside the tank for opening and closing the air discharge valves;

wherein the first air discharge valve of the plurality of air discharge valves and the open/close unit are located in such a positional relationship that the first air discharge valve is opened and closed at a timing which is delayed with respect to the second air discharge valve of the plurality of air discharge valves;

wherein the open/close unit has a plurality of air discharge rods for opening and closing the plurality of air discharge valves correspondingly, further comprising:

an actuator for driving the air discharge rods simultaneously; and wherein one or more of the air discharge rods of the plurality of air discharge rods are different in length from the other air discharge rod(s).

2. An ink jet printer comprising:

a recording head for discharging a plurality of inks from a plurality of nozzles to print on a recording medium;

a tank having a plurality of storage chambers for respectively storing the plurality of inks to be supplied to the recording head;

a plurality of air discharge passages for discharging air in the plurality of storage chambers respectively to outside;

a plurality of air discharge valves provided respectively in the air discharge passages so as to be opened and closed; and an open/close unit provided outside the tank for opening and closing the air discharge valves;

wherein the first air discharge valve of the plurality of air discharge valves and the open/close unit are located in such a positional relationship that the first air discharge valve is opened and closed at a timing which is delayed with respect to the second air discharge valve of the plurality of air discharge valves;

wherein the open/close unit has a plurality of air discharge rods for opening and closing the plurality of air discharge valves correspondingly, further comprising:

an actuator for driving the air discharge rods simultaneously;

wherein each of the plurality of air discharge valves has a valve rod for coming into direct contact with the air discharge rod and a valve body for covering the air discharge passage; and wherein one or more of the valve rods of the plurality of valve rods are different in length from the other valve rod(s).

3. The ink jet printer according to claim 2;

wherein an elastic member is arranged next to each of the valve bodies for increasing sealing with respect to the air discharge passages.

4. An ink jet printer comprising:

a recording head for discharging a plurality of inks from a plurality of nozzles to print on a recording medium;

a tank having a plurality of storage chambers for respectively storing the plurality of inks to be supplied to the recording head;

a plurality of air discharge passages for discharging air in the plurality of storage chambers respectively to outside;

a plurality of air discharge valves provided respectively in the air discharge passages so as to be opened and closed; and an open/close unit provided outside the tank for opening and closing the air discharge valves;

wherein the first air discharge valve of the plurality of air discharge valves and the open/close unit are located in such a positional relationship that the first air discharge valve is opened and closed at a timing which is delayed with respect to the second air discharge valve of the plurality of air discharge valves; and wherein one or more of the air discharge valves of the plurality of air discharge valves are arranged different in position along an opening and closing direction from the other air discharge valve(s).

5. The ink jet printer according to claim 1;

wherein the open/close unit has an air discharge cap for covering opening ends to outside of the air discharge passages, further comprising:

a suction unit for sucking air from the air discharge passages via the air discharge cap.

6. The ink jet printer according to claim 5;

wherein the air discharge cap has a rim portion provided extending upwardly from a circumferential edge of the air discharge cap, and the rim portion closely comes into contact with a circumference of the opening ends.

7. The ink jet printer according to claim 5, further comprising:

a nozzle cap for covering the nozzles of the recording head;

wherein the suction unit sucks the ink from the nozzles via the nozzle cap.

8. The ink jet printer according to claim 7;

wherein the nozzle cap has a rim portion provided extending upwardly from a circumferential edge of the nozzle cap, and the rim portion closely comes into contact with the recording head.

9. The ink jet printer according to claim 1;

wherein each of the air discharge valves and the open/close unit are located in such a positional relationship that the plurality of air discharge valves are opened and closed in sequence at timings which are delayed one after another.

10. The ink jet printer according to claim 2;

wherein the open/close unit has an air discharge cap for covering opening ends to outside of the air discharge passages, further comprising:

a suction unit for sucking air from the air discharge passages via the air discharge cap.

11. The ink jet printer according to claim 10;

wherein the air discharge cap has a rim portion provided extending upwardly from a circumferential edge of the air discharge cap, and the rim portion closely comes into contact with a circumference of the opening ends.

12. The ink jet printer according to claim 10, further comprising:

a nozzle cap for covering the nozzles of the recording head;

wherein the suction unit sucks the ink from the nozzles via the nozzle cap.

13. The ink jet printer according to claim 12;

wherein the nozzle cap has a rim portion provided extending upwardly from a circumferential edge of the nozzle cap, and the rim portion closely comes into contact with the recording head.

14. The ink jet printer according to claim 2;

wherein each of the air discharge valves and the open/close unit are located in such a positional relationship that the plurality of air discharge valves are opened and closed in sequence at timings which are delayed one after another.

15. The ink jet printer according to claim 4;

wherein the open/close unit has an air discharge cap for covering opening ends to outside of the air discharge passages, further comprising:

a suction unit for sucking air from the air discharge passages via the air discharge cap.

16. The ink jet printer according to claim 15;

wherein the air discharge cap has a rim portion provided extending upwardly from a circumferential edge of the air discharge cap, and the rim portion closely comes into contact with a circumference of the opening ends.

17. The ink jet printer according to claim 15, further comprising:

a nozzle cap for covering the nozzles of the recording head;

wherein the suction unit sucks the ink from the nozzles via the nozzle cap.

18. The ink jet printer according to claim 17;

wherein the nozzle cap has a rim portion provided extending upwardly from a circumferential edge of the nozzle cap, and the rim portion closely comes into contact with the recording head.

19. The ink jet printer according to claim 4;

wherein each of the air discharge valves and the open/close unit are located in such a positional relationship that the plurality of air discharge valves are opened and closed in sequence at timings which are delayed one after another.

* * * * *